US008225844B2

(12) United States Patent
Seeber et al.

(10) Patent No.: US 8,225,844 B2
(45) Date of Patent: Jul. 24, 2012

(54) METHOD FOR PROCESSING MOULDING SAND

(75) Inventors: Roland Seeber, Hardheim (DE); Clemens Kohler, Tauberbischofsheim (DE)

(73) Assignee: Maschinenfabrik Gustav Eirich GmbH & Co. KG, Hardheim (DE)

( * ) Notice: Subject to any disclaimer, the term of this patent is extended or adjusted under 35 U.S.C. 154(b) by 418 days.

(21) Appl. No.: 12/663,910

(22) PCT Filed: Apr. 18, 2008

(86) PCT No.: PCT/EP2008/054769

§ 371 (c)(1),
(2), (4) Date: Dec. 10, 2009

(87) PCT Pub. No.: WO2008/151874

PCT Pub. Date: Dec. 18, 2008

(65) Prior Publication Data

US 2010/0181042 A1 Jul. 22, 2010

(30) Foreign Application Priority Data

Jun. 11, 2007 (DE) ..... 10 2007 027 298

(51) Int. Cl.
*B22D 46/00* (2006.01)

(52) U.S. Cl. ..... 164/456; 164/4.1

(58) Field of Classification Search ..... 164/4.1, 164/456

See application file for complete search history.

(56) References Cited

U.S. PATENT DOCUMENTS

| | | | | |
|---|---|---|---|---|
| 3,838,847 | A | | 10/1974 | Tegelhutter |
| 4,569,025 | A | * | 2/1986 | Eirich et al. ..... 700/265 |
| 5,816,312 | A | | 10/1998 | Suginaka et al. |

FOREIGN PATENT DOCUMENTS

| | | | |
|---|---|---|---|
| CH | 517 541 | A | 1/1972 |
| DE | 13 01 874 | B | 8/1969 |
| DE | 19 47 566 | A1 | 8/1970 |
| DE | 20 53 936 | A1 | 5/1971 |
| DE | 32 20 662 | A1 | 8/1983 |
| DE | 195 36 803 | A1 | 4/1996 |
| JP | 56 053844 | A | 5/1981 |

* cited by examiner

*Primary Examiner* — Jessica L Ward
*Assistant Examiner* — Steven Ha
(74) *Attorney, Agent, or Firm* — Paul & Paul

(57) ABSTRACT

The present invention concerns a method for processing molding sand.

Figure 1:
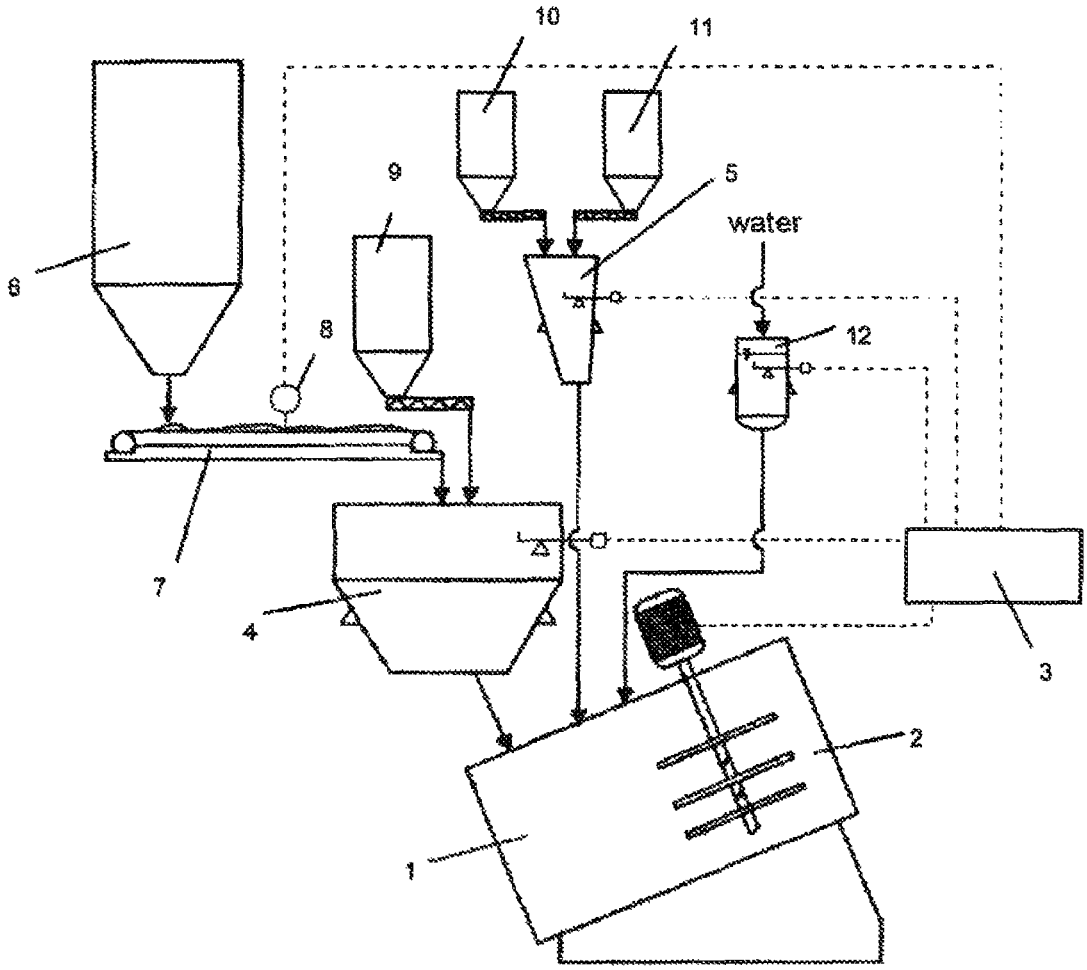

In order to provide a method with a simple regulating system to control the compressibility of a reclaimed molding sand, the invention proposes that the molding sand be divided into several charges and the processing parameters, such as the quantity of water, the quantity of new sand and/or the quantity of clay to be added, is corrected on the basis of the difference following processing between the actual compressibility and the reference compressibility of the molding sand, measured for the preceding charge.

13 Claims, 3 Drawing Sheets

METHOD FOR PROCESSING MOULDING SAND

The present invention relates to a method for processing moulding sand.

BACKGROUND OF THE INVENTION

Casting is probably the most important traditional moulding method. A melting charge of the material to be processed is cast into a mould in which it then solidifies to produce the casting.

Frequently, so-called lost moulds are used. Such moulds are produced from moulding sand, i.e. quartz sand and a bonding agent. Such moulds are usually formed by taking a mould from models. The liquid material is then cast into the mould. After the material has hardened, the moulding sand can be removed, i.e. the casting is unmoulded, whereupon the mould is destroyed. For this reason, this type of mould is known as a lost mould.

In order to optimize mould production the sand must, inter alia, be supplemented with suitable bonding agents. When producing moulds, it is thus essential to ensure that the properties of the moulding sand to be used are as best suited to the material as is possible. Thus, for example, the casting material used and the associated melting charge temperature and also the external and if appropriate the internal contour of the mould must be taken into account.

The quality of the moulding sand primarily depends on the clay content, the grain size and distribution, the shape and surface area of the quartz bodies, the type and quantity of the auxiliary materials, the moisture content and the degree of compression.

For economic and environmental reasons, the spent moulding sand is usually processed and reclaimed as completely as possible; the more so because 5 to 15 parts by weight of moulding sand is generally used per unit weight of casting. At least 90% of the spent moulding sand can be processed and fed back into the moulding circuit, since the bond coatings are usually still effective, so that only water and occasionally bonding agent has to be added. A portion of the old sand is discarded from the circuit and replaced with fresh replacement material.

Frequently, clay bonded moulding sands are used, which are usually fed back into the preparation method following the casting process, where appropriate quantities of water, bonding agent (for example bentonite), additives (for example coal dust) and fresh sand are again added to the old sand.

Processing is generally carried out in a mixer and usually under vacuum, in order to cool the moulding sand down at the same time. On processing, care has to be taken to ensure that the bonding agent coats the quartz sand grains in an optimal manner.

The intention of this processing is so that the processed sand leaving the mixer is of uniform quality. The quality of old foundry sand, however, varies due to the thermal load during the casting process which depends on the production program used, so that constantly, old sand with a variable moisture and clay content is fed back to the processing plant.

The perpetual aim of a properly functioning process is thus to detect variations in the old sand and to correct them by taking corrective measures in the preparation process, such as adapting the water addition or the bond content.

DESCRIPTION OF THE PRIOR ART

Many very different methods can be used for this purpose. As an example, the method disclosed in DE 32 20 662 usually employs a measuring device located downstream of or directly in the mixer to take a sample and directly determine the compressibility as well as other parameters, such as the compressive strength and/or shear strength. In addition, the moisture content in the old sand in the mixer is directly determined using a moisture sensor in order to correct the quantity of water to be added and the compressibility and moisture content data obtained are used to correct the quantity of water as well as the auxiliary material to be added in order to achieve a constant moulding sand quality for the processed moulding sand.

The disadvantage of all of these methods is that one or more additional, possibly expensive measuring devices are required to determine the moisture content as well as the sand parameters under consideration.

CH 517 541 discloses a method for adjusting the moisture content of mixing goods whereby the water is added to the mixture intermittently in two or more stages with varying addition and rest times as a function of several adjustable values for the output of the motor of an auxiliary tool, until a pre-set reference value is successively reached. Since the change in the motor output following addition of a certain quantity of water does not take place abruptly, but a certain mixing time is necessary until a stationary condition and thus a constant value for the measurement is reached, the mixing time changes substantially as a function of the required total water content. In order to achieve a uniform sand quality, in addition to as constant a moisture content as possible, a constant mixing time is also necessary for a sufficiently high water content which, however, is not achievable with the method cited above.

DE 2053936 describes a further development of CH 517 541 wherein in addition to the current drawn by the fast-running auxiliary tool, the current drawn by the rotating mixing container is considered for more precise determination of the moisture content of the mixture.

Here again, water addition is carried out successively in several steps into the moulding sand mixture to be processed at that time by controlling magnetic valves in water supply lines. In addition, to correct the quantity of water, a temperature signal is incorporated into the calculation. Even this improved solution results in unnecessarily long and above all variable length wet mix times, since after every addition of a part quantity of water, the mix needs a certain time before it builds up a constant higher resistance to the mixing tool.

DE 1 947 566 discloses a method with a mixing drum inclined to the horizontal fed continuously with a stream of moulding sand, whereby the motor output of the rotating mixing drum is used to regulate the added moisture. With varying added quantities or varying starting moisture contents for the added moulding sand, here again the amount of bulk in the drum varies and thus so does the mass of solid as well as the power consumption of the motor, so that long wavelength fluctuations in the properties of the old sand cannot be compensated for.

U.S. Pat. No. 3,838,847 discloses a further development of DE 1 947 566 wherein the liquid is admitted into a conical mixing drum inclined to the horizontal fed continuously with a stream of moulding sand as a function of the torque of a mixing tool operating in counter-current mode to the mixing container so that the torque on the mixing tool is constant.

The disadvantage of this solution is that the residence time in the mixer cannot be tailored and is dependent on the dosing power of the supply conveyor. Furthermore, the angle of repose of the inflowing moulding sand in the drum mixer is strongly dependent on the initial moisture content and thus the mixing tool is covered in variable amounts of moulding sand, which also has a large effect on the motor output. Since in addition, here again a certain time is required following the addition of the water to the moulding sand until the water can produce a noticeable change in the resistance and thus the power consumption, this method can easily result in overwetting of the moulding sand.

A similar situation occurs with the batch method described in DE 1 301 874, whereby water addition is continuous into the mix, after adding the old sand, until a certain power consumption is measured on the rotor. Due to the time-lapsed reaction of the mix in response to the water addition and the extreme dependency noted in the document of the consumption on very small changes in moisture content in the region of the desired final moisture content, this method can swiftly result in overwetting of the mixing material. Because of this problem, that same inventor developed the successive addition of portions of water as described in DE 2 053 936 and CH 517 541 with appropriate intervals between the individual addition steps.

JP 56053844 describes a method for correcting moulding sand quality by altering the weighed-in quantities of solids, which results from the time-programmed addition of old sand into a hopper, by measuring the output of a milling drive. In the method of the invention, the moisture content and the bentonite content of the old sand in a milling mixer are corrected on the basis of a difference in the motor output between a measurement following addition of old sand to the mixer and a second measurement following addition of a predefined quantity of water and bond as well as a fixed mixing period.

The compensation for the missing water and bond quantity is carried out following a second measurement into the same charge of moulding sand based on the experimentally determined relationship between the moisture content and the difference in motor output and the bond content and the difference in motor output. The simultaneous correction of two operational parameters, moisture content and bentonite content, which are also interdependent, based on only one measured parameter, motor output, as well as at a non-constant quantity of material in the mixer and also variable old sand compositions, necessarily results in larger rather than smaller variations in the quality of the moulding sand.

SUMMARY OF THE INVENTION

The aim of the present invention is to provide a method with a simple adjustment system to control the compressibility of a reclaimed moulding sand.

This aim is achieved by dint of a method for processing moulding sand, having the following steps:

a) dividing the moulding sand to be processed into at least two moulding sand portions;
b) adding a first moulding sand portion to be processed to a mixer;
c) moving a mixing tool provided in the mixer;
d) measuring the force required to move the mixing tool;
e) determining the actual compressibility of the moulding sand portion in the mixer from the measured force;
f) determining the difference between the actual compressibility and a reference compressibility;
g) determining the quantity of water to be added to the moulding sand portion in the mixer from the difference;
h) adding the quantity of water determined in g) to the moulding sand portion;
i) moving the mixing tool provided in the mixer for a predetermined period of time;
j) measuring the force required to move the mixing tool;
k) determining the actual compressibility of the processed first moulding sand portion from the measured force;
l) determining the difference between the actual compressibility and the reference compressibility;
m) determining a corrective quantity of water and/or a corrective quantity of new sand and/or a corrective quantity of clay from the difference between the actual compressibility and the reference compressibility;
n) repeating steps b) to m) with a second moulding sand portion to be processed, wherein before or together with step h) the corrective quantity of water and/or the corrective quantity of new sand and/or the corrective quantity of clay is added to the further moulding sand portion.

FURTHER DESCRIPTION OF THE INVENTION

Accordingly, initially a portion of the moulding sand to be processed is placed in a mixer and the force required to move the mixing tool is measured. The simplest way to measure this force is indirectly via the output of the mixer. It is not absolutely necessary to determine an exact value for the required force; rather, it is entirely sufficient to measure a magnitude which represents a measure of the required force since in this method it is not so much the force but rather the compressibility of the moulding sand which is of importance. There are many methods of measuring the compressibility of moulding sand. If, for example, the moulding sand is placed in a measuring cylinder and compressed with a predefined pressure, then the reduction in height of the moulding sand in the measuring cylinder, as a %, is termed the compressibility.

It is known from DE 3220662 that the compressibility of moulding sand is approximately linearly dependent on the degree of wetting or the moisture content for a constant clay content.

Experience has shown that this relationship is only valid for moisture contents of more than 2%. Below a moisture content of 2%, the relationship is distinctly non-linear, since insufficient binding of the grains of sand in the moulding sand is present. The compressibility increases with increasing clay content.

As an example, a constant quantity of old sand is charged into the mixer via a gravimetric solids weighing hopper. After all of the old sand has been added to the mixer, the power consumption of the drive motor $MP_1$ is recorded and transformed into an actual moisture content $F_1$ using the experimentally determined calibration curve between motor output and the moisture content. Using the known relationship between moisture content and compressibility for a given clay content SG, the necessary reference moisture content $F_{reference}$ is determined from the reference compressibility $V_{reference}$ and the resulting moisture content difference $\Delta F_1$ is compensated for by a single addition of water to the mixer.

After adding the quantity of water, the moulding sand is processed by mixing for a predetermined mixing period in the mixer and at the end of processing of this portion of moulding sand, shortly before emptying, a second measurement $MP_2$ is taken of the output of the mixing tool. Using the known relationship between the output and the moisture content, an actual moisture content $F_2$ or actual compressibility $V_2$ can thus be determined for the moulding sand. Because of variations in the clay content of the old sand, this can now lead to divergences between the reference compressibility $V_{reference}$ and the measured actual compressibility $V_2$.

The difference in compressibility $\Delta V_2$ arising from the divergence is now transformed into a moisture content corrective value $F_{corr}$ using a predetermined correction function which is taken into account for the subsequent moulding sand charge to be processed when determining the required quantity of water to be added.

$$F_{reference,\,i}=F_{1,i}+\Delta F_1-F_{corr,i}+F_{evap}(T_i) \quad (1)$$

where $F_{corr,i}=F_{corr,i-1}+F_{corr}(\Delta V_{2,i-1})$ where i is the charge number, i.e. i=1 for the first moulding sand portion, i=2 for the second portion of moulding sand, etc.

Processing of the subsequent moulding sand portions is thus influenced by the corrective measurement which was made for the immediately preceding step for processing the moulding sand portion following its processing. By means of this corrective intervention in the processing of the subsequent moulding sand portion, on the one hand the mixing time in the mixer can be kept constant and on the other hand, long wavelength variations in the old sand composition can be compensated for. This results in auto-adaptation of the corrective water quantities to gradual changes in sand composition. In other words, the compressibility at the end of processing is monitored and—if a divergence from the reference value is observed—the processing of subsequent moulding sand portions is correspondingly adapted. The corrective value is no longer applied to the moulding sand portion for which the divergence was established, but only to subsequent moulding sand portions to be processed.

In case the moulding sand to be processed has a raised temperature with respect to the surroundings, following the addition of water, a portion of the water which is to be added is evaporated in the parts of the plant which are downstream of the mixer, for example the discharging belt. In order to compensate for this loss of moisture, in a preferred implementation, the expected loss of moisture through evaporation is calculated from the temperature of the old sand using an energy balance and this additional moisture $F_{evap}(T)$ is also added to the moulding sand.

In a further embodiment, the mixer is evacuated during processing. This results in a reduction of the boiling point of the water contained in the moulding sand, so that at least a portion of the water evaporates and the evaporation energy required means that the remaining moulding sand is effectively cooled. Since the reclaimed moulding sand is primarily obtained from the destroyed mould, it is in any event too hot for further processing and must be cooled down. Processing under vacuum not only shortens the preparation method, but also results in better quality of the moulding sand to be processed.

In order to retain the moisture content of the moulding sand, in this variation for processing the moulding sand, in addition to being supplemented with a quantity of water for evaporation, which in this case is given by the final temperature of the moulding sand to be processed which corresponds to the applied final pressure, a supplement prior to processing of exactly the quantity of water $F_{cool}$ which is necessary to cool the moulding sand from its actual temperature to the reference temperature is made. To this end, a measurement of the temperature of the unprocessed moulding sand can be used, whereupon the temperature measurement can be carried out in the old sand supply line.

The temperature of the old sand which, for example, is conveyed via old sand belts to the weighing hopper, is then captured on the way to the weighing hopper and used for the subsequent water correction to compensate for the evaporation water or for processing under vacuum to determine the water content which is used for evaporation cooling.

Thus, the temperature-dependent water loss $F_{evap}(T)$ by evaporation is calculated by the previously measured old sand temperature in the old sand or from the boiling point calculated from the final pressure of the vacuum processing using the steam pressure curve in known manner via an energy balance, and is then added to the mixture in addition.

In a particularly preferred implementation, the corrective function for the moisture content correction as a function of the determined moisture content difference between the actual compressibility and the reference compressibility at the end of the preparation is divided into 3 sections. In a first section, the corrective function follows an $n^{th}$ order polynomial with n>1, so that small divergences result in only small changes in the moisture addition and large divergences have a greater effect. In a second section, which lies directly next to the first section, the moisture content correction follows a linear relationship, and in a third section, which lies directly next to the second section, it is limited by the set maximum value.

In a further implementation of the invention, the correction of the compressibility difference is carried out alternatively to or in combination with the addition to the mix of new sand or a mixture of finely divided materials such as bentonite, coal dust and filtered dust. After addition of a predefined and gravimetrically checked quantity of solid into the mixer is complete, the power consumption of the drive motor is recorded and transformed into an actual moisture content using the calibration curve between the motor output and the moisture content. The difference between a previously defined final moisture content taking into account the evaporation water based on the temperature of the old sand is compensated for by adding water to the mix.

$$F_{reference,i}=F_{1,i}+\Delta F_1+F_{evap}(T_i) \quad (2)$$

After adding the entire quantity of water, the moulding sand is processed in the mixer for a predetermined mixing period and when processing of this moulding sand portion is complete, a second measurement of the output of the mixing tool is taken shortly before emptying. The known relationship between the output and the moisture content or the compressibility for a given clay content is used to determine the difference between the actual and reference compressibility.

This compressibility difference is now transformed via a sectionally defined corrective function into a corrective value to correct the clay content in the recipe which is taken into account in the subsequent preparation of another moulding sand portion to determine the required additional quantities to be added.

In the case of a positive difference between the actual and reference compressibility, the clay content in the mixture is too low and must be increased by adding fines, for example in the form of a mixture of bentonite, coal dust and filtered dust, while a negative difference between the actual and reference compressibility means that the clay content in the mixture is too high and coarse new sand must be added to reduce it.

The corrective function for the additional substances as a function of the compressibility difference determined at the end of processing between the actual compressibility and the reference compressibility can be divided into 3 sections. In a first section, the corrective function follows an nth order polynomial with n>1, so that small divergences result in only very small changes in the amount of additional substances to be added. In a second section, which lies directly next to the first section, the additional substance correction follows a linear relationship, and in a third section, which lies directly next to the second section, it is limited by the set maximum value.

In a further advantageous implementation of the invention, in order to shorten the total preparation period while maintaining a constant wet mixing period, which determines the quality, a portion, preferably 80-90%, of the required quantity of water can be metered into the mixer, the quantity being based on the quantity of water determined for the previously processed moulding sand portion, simultaneously with the addition of the old sand or new sand and the additives to the mixer.

In this manner, on the one hand it can be ensured that the moisture content of the sand at the beginning of the first measurement of the output is definitely above the required minimum moisture content of 2%, and on the other hand the required wet mixing time for high moisture contents can be kept to significantly shortened moulding sand portion processing times. The minimum moisture content of 2% is necessary in this case since only here is the relationship between the compressibility and moisture content linear.

The missing quantity of moisture necessary to achieve the predetermined reference compressibility can be determined based on the first output measurement after adding and mixing in the water. After determining and adding the remaining quantity of water under equation (1), which in this case only compensates for the missing 10% to 20%, shortly before emptying the second output measurement is recorded for an overall constant wet mixing time so that the actual moisture content or the actual compressibility can be determined therefrom and is available for correction of the quantity of water to be added in the subsequent moulding sand portion.

Further preferred implementations are defined in the dependent claims.

Further advantages, features and embodiments of the present invention will become apparent from the following description made with reference to the accompanying drawings, which show:

BRIEF DESCRIPTION OF THE DRAWING FIGURES

Figure 2:
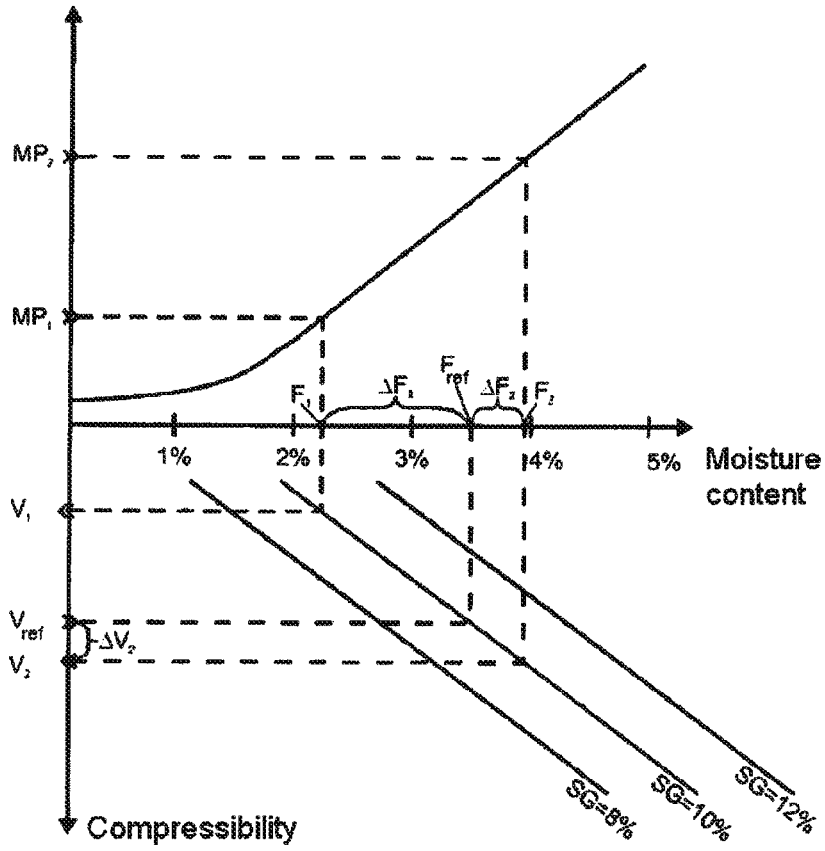
Figure 3:
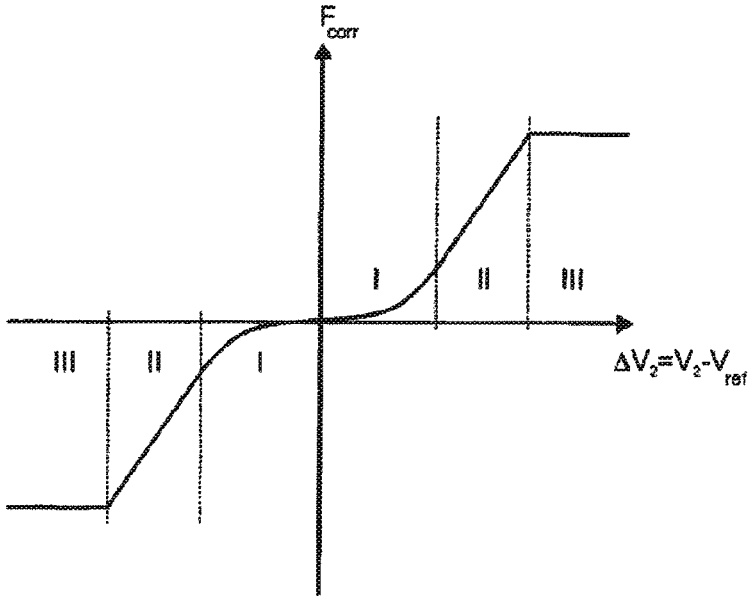
Figure 4:
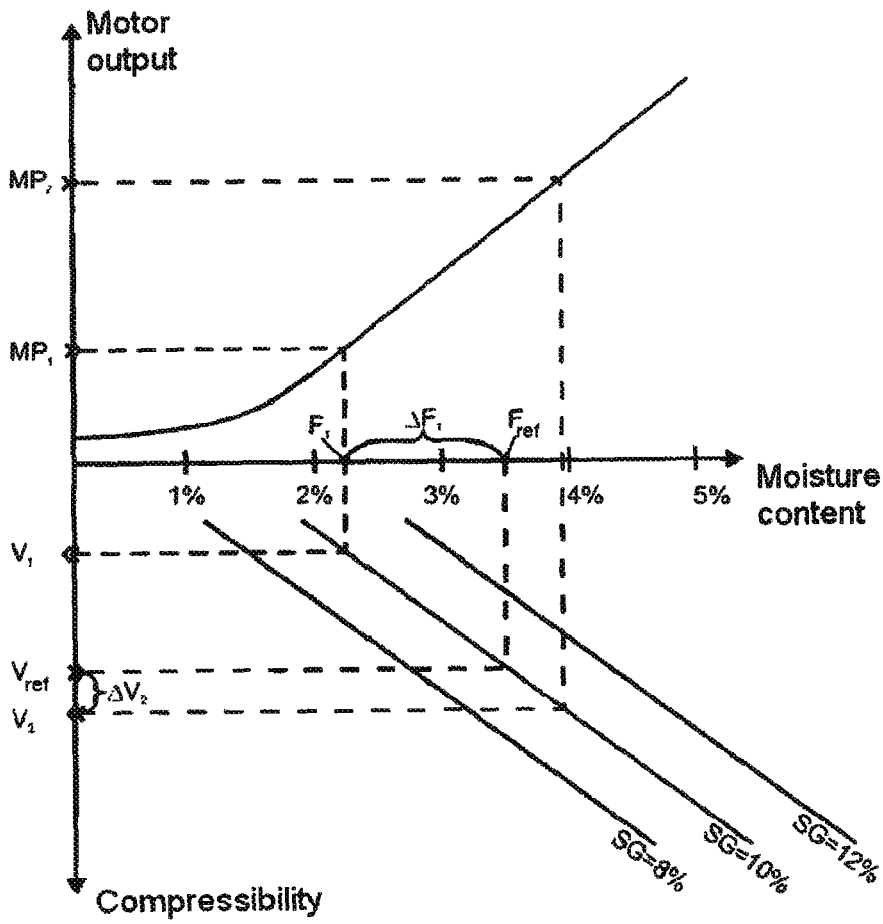
Figure 5:
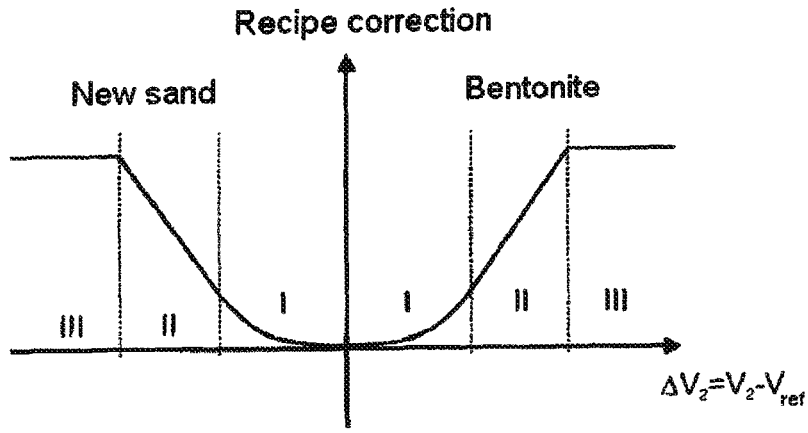

FIG. 1 a diagrammatic representation of a plant for carrying out the method;

FIG. 2 a diagrammatic representation showing the experimentally determined relationship between the motor output and moisture content or the known relationship between moisture and compressibility of foundry sand for various clay contents;

FIG. 3 a diagrammatic representation of the moisture content corrective function divided into three sections as a function of the difference between reference and actual compressibility;

FIG. 4 a further diagrammatic representation with an experimentally determined relationship between motor output and moisture content or the known relationship between moisture and compressibility of foundry sand for various clay contents; and FIG. 5 a diagrammatic representation of the clay content corrective function divided into three sections as a function of the difference between reference and actual compressibility.

DETAILED DESCRIPTION OF THE DRAWING FIGURES

FIG. 1 shows, in a diagrammatic manner, a plant for carrying out the method of the invention having a moulding sand mixer 1 which has a cantilevered, fast running mixing tool 2. The motor output is determined in known manner by recording the motor voltage and motor current taking into account the phases and is supplied to a control device 3. The moulding sand mixer 1 is supplied with solids via an old sand weighing hopper 4 and an additive weighing hopper 5. The old sand weighing hopper 4 is charged with old sand from an old sand silo 6 via, for example, a conveyor belt 7 up to a predetermined weight. While the old sand is transported from the old sand silo 6 to the old sand weighing hopper 4, the temperature of the old sand is determined continuously on the conveyor belt using a temperature sensor 8 and a mean value for the old sand temperature is calculated therefrom and supplied to the control device 3. Following old sand addition to the old sand weighing hopper 4, a fixed predetermined amount of new sand 9 is added from a further new sand silo. At the same time, the predetermined quantities of additives such as bentonite 10 and coal dust 11 are weighed in an additive weighing hopper 5. A sufficient quantity of water is provided in a liquid weighing hopper 12, so that the calculated quantity of liquid can be supplied by outlet weighing in full to the moulding sand in the mixer 1 without interruption.

The individual weights for the solid weighing hoppers are also gravimetrically metered via the control device in order to be able to provide a constant total weight of solids to the mixer 1.

The lower part of the diagram shown in FIG. 2 shows the known relationship between the compressibility and moisture content. Various calibration curves are shown which depend on the clay content; they are offset in the direction of increasing moisture content for a higher clay content SG. The upper portion of FIG. 2 shows the experimentally determined relationship between the motor output MP and the moisture content of the mixture. Beyond a moisture content of 2%, the motor output rises in a linear manner with moisture content. The calibration line shown represents the total weight of the moulding sand initial weight. Below a moisture content of 2%, because of the as yet incomplete binding between the grains of sand, the relationship between motor output and moisture content is distinctly non-linear.

The utility of this region for the purposes of regulating compressibility is only limited, and so preferably a starting moisture content of more than 2% is selected.

As an example, this can be ensured by adding water in an amount representing 80-90% of the quantity of water which was added to the previous moulding sand portion (also termed the preceding charge) at the same time as the solids are added to the mixer.

FIG. 3 diagrammatically shows the moisture content corrective function as a function of the difference in compressibility, which is used to correct the quantity of water to be added to the subsequent charge. For both positive and negative divergences in the compressibility, the corrective function is divided into three different sections. In a first section I, the corrective function follows an $n^{th}$ order polynomial with $n>1$, with the aim that small divergences from the reference value are only slightly corrected if at all, while for larger divergences an overproportionally larger correction is required. In order that the correction at large divergences does not become too great, the first section I connects to a second section II which preferably behaves in a linear manner, whereby the divergences between compressibility and moisture content are directly proportional. To prevent the control loop from starting to oscillate, for very large divergences, which as a rule are due to isolated events rather than to long wavelength variations, the corrections are limited by an upper limiting corrective value (see section III).

FIG. 4 shows the basically similar relationship between motor output, moisture content and compressibility for various clay contents as shown in FIG. 2, with reference numerals which are unnecessary for the illustration being omitted. The quantity of liquid to be added is calculated, without further corrective functions, directly from the difference between the moisture content obtained from the output $MP_1$ and the reference moisture content $F_{reference}$ obtained from the reference compressibility at a given clay content. The divergences due to a varying clay content between the actual moisture content at the end of charge $F_2$, which is calculated from the output $MP_2$ shortly before emptying the mixer using the calibration curve, and the reference moisture content $F_{reference}$ in this case are compensated for by an intervention in the control of the solid addition metering. The corrective function used here is diagrammatically shown in FIG. 5. While correcting the quantity of water to be added requires only a larger or smaller quantity of water to be added, when correcting the solids addition, a decision has to be made between adding coarse new sand to reduce the clay content or to add fines to raise the clay content. As can be seen in FIG. 5, a positive divergence between the compressibility at the end of the processing in the mixer, $V_2$, and the reference compressibility means the clay content is too low, so that this can be compensated for by adding fines, for example in the form of bentonite or a mixture of bentonite, coal dust and possibly also filtered dust.

A negative divergence between the compressibility at the end of processing in the mixer, $V_2$, and the reference compressibility means that the clay content in the mixture is too high, so that this can be compensated for by adding coarse material in the form of new sand.

Both the corrective functions for the sand addition and the fines addition of bentonite, for example, are also preferably divided into three different sections. In a first section, the corrective function follows an $n^{th}$ order polynomial with n>1, so that small divergences from the reference are only slightly corrected if at all, while for larger divergences an over-proportionally large correction is carried out. In order that the correction for large divergences is not too large, the first section leads into a second section which preferably exhibits linear behaviour, wherein the divergences between compressibility and moisture content are directly proportional. In order to prevent the control loop from oscillating, for very large divergences, which as a rule are due to isolated events rather than to long wavelength variations, are limited by an upper corrective value.

The invention claimed is:

1. A method for processing molding sand comprising the following steps:

a) dividing the molding sand to be processed into at least two molding sand portions; then, b) adding a first molding sand portion to be processed to a mixer; then, c) moving a mixing tool provided in the mixer; then, d) measuring the force required to move the mixing tool; then, e) determining the actual compressibility of the molding sand portion in the mixer from the measured force; then, f) determining the difference between the actual compressibility and a reference compressibility; then, g) determining the quantity of water to be added to the molding sand portion in the mixer from the difference; then, h) adding the quantity of water determined in g) to the molding sand portion; then, i) moving the mixing tool provided in the mixer for a predetermined period of time; then, j) measuring the force required to move the mixing tool; then, k) determining the actual compressibility of the processed first molding sand portion from the measured force; then, l) determining the difference between the actual compressibility and the reference compressibility; then, m) determining a corrective quantity of water or a corrective quantity of new sand or a corrective quantity of clay from the difference between the actual compressibility and the reference compressibility; then, n) repeating steps b) to m) with a second molding sand portion to be processed, wherein before or together with step h) the corrective quantity of water or the corrective quantity of new sand or the corrective quantity of clay is added to the further molding sand portion.

2. A method according to claim 1, characterized in that in step a) the division is into at least three portions of molding sand and wherein the corrective quantities defined in step m) are respectively added to the subsequent molding sand portion.

3. A method according to claim 1 or claim 2, characterized in that the temperature of the molding sand portion to be measured is measured before step i) and the difference between the measured temperature and a reference temperature is used to calculate the evaporation water quantity $F_{evap}$, and the evaporation water quantity $F_{evap}$ is added to the mixer before step i).

4. A method according to claim 1 or claim 2, characterized in that a vacuum is formed in the mixer during step i).

5. A method according to claim 4, characterized in that the temperature of the molding sand portion to be processed is measured before step d) and the difference between the measured temperature and a reference temperature is used to calculate the quantity of water $F_{cool}$ to be added which is necessary to cool the molding sand portion by evaporation cooling to the reference temperature.

6. A method according to one of claims 1 to 2, characterized in that in the second and every further molding sand portion at least 1/10 of the quantity of water determined in step g) for the first or preceding molding sand portion, corrected if necessary with the corrective quantity of water determined in step m) is added before step d).

7. A method according to one of claims 1 to 2, characterized in that the predetermined time period is the same for all molding sand portions to be processed.

8. A method according to one of claims 1 to 2, characterized in that the corrective quantity of water is calculated in step m).

9. A method according to claim 8, characterized in that the corrective quantity of water is determined using a linear corrective function.

10. A method according to claim 8, characterized in that the corrective quantity of water is limited by a predetermined limiting quantity of water.

11. A method according to claim 8, characterized in that for small differences measured between the actual compressibility and the reference compressibility, the corrective quantity of water is determined by means of an $n^{th}$ order corrective function, wherein n>1.

12. A method according to one of claims 1 to 2, characterized in that in step m) a corrective quantity of new sand or a corrective quantity of clay is determined from the difference between the actual compressibility and the reference compressibility, and the corrective quantity of new sand or the corrective quantity of clay is preferably added in step b) for the subsequent molding sand portion to be processed.

13. A method according to claim 12, characterized in that in step m) a water corrective quantity is determined from the difference between the actual compressibility and the reference compressibility and the corrective quantity of water is preferably taken into account when adding the quantity of water determined in g) to the molding sand portion in step h) for the subsequent molding sand portion to be processed.

* * * * *